US009051940B2

(12) United States Patent
Paddock et al.

(10) Patent No.: US 9,051,940 B2
(45) Date of Patent: Jun. 9, 2015

(54) METHOD AND APPARATUS FOR ADJUSTING IMPELLER/RING CLEARANCE IN A PUMP

(75) Inventors: Douglas Paddock, Penn Yan, NY (US); Mark A. Playford, Seneca Falls, NY (US)

(73) Assignee: ITT MANUFACTURING ENTERPRISES LLC.

( * ) Notice: Subject to any disclaimer, the term of this patent is extended or adjusted under 35 U.S.C. 154(b) by 455 days.

(21) Appl. No.: 13/540,266

(22) Filed: Jul. 2, 2012

(65) Prior Publication Data

US 2013/0028706 A1 Jan. 31, 2013

Related U.S. Application Data

(60) Provisional application No. 61/504,008, filed on Jul. 1, 2011.

(51) Int. Cl.
*F04D 7/04* (2006.01)
*F04D 29/08* (2006.01)
(Continued)

(52) U.S. Cl.
CPC ..... *F04D 29/167* (2013.01); *F04D 29/622* (2013.01); *F04D 29/086* (2013.01); *F04D 7/04* (2013.01); *F04D 29/4286* (2013.01); *F04D 29/628* (2013.01)

(58) Field of Classification Search
CPC ... F04D 29/086; F04D 29/167; F04D 29/622; F04D 29/628; F04D 7/04; F04D 29/4286
USPC ..... 415/126, 128, 131, 132, 173.2, 174.1, 415/196, 197, 230, 231, 118; 29/889.2, 29/451, 525.11, 888.02, 888.021, 29/888.024; 277/422, 508, 585
See application file for complete search history.

(56) References Cited

U.S. PATENT DOCUMENTS

| | | | |
|---|---|---|---|
| 1,735,754 | A | 11/1929 | Hargis |
| 2,285,976 | A | 6/1942 | Huitson |

(Continued)

FOREIGN PATENT DOCUMENTS

| | | |
|---|---|---|
| JP | 57070997 | 5/1982 |
| JP | 6026499 | 2/1994 |
| WO | 0057056 | 9/2000 |

OTHER PUBLICATIONS

1 Page English Language Abstract of JP6026499 , Feb. 1, 1994.

(Continued)

*Primary Examiner* — Christopher Verdier

(57) ABSTRACT

In a pump arrangement, each adjusting screw has first and second end portions, a third intermediate raised portion, and a fourth portion to allow each adjusting screw to be rotated clockwise/counterclockwise. Each first end portion passes through a suction liner aperture so left-handed threads couple to a respective left-handed seal ring aperture. Each second portion passes through a suction half casing aperture so the fourth portion can be accessed to allow clockwise/counterclockwise rotation of each adjusting screw. Each adjusting screw rotates clockwise and moves until the third portion pushes against the suction half casing, so the screw stops moving and the seal ring moves away from the suction liner as the screw is rotated clockwise, or rotates counterclockwise and moves until the third portion pushes against the suction liner, so the screw stops moving and the seal ring moves towards the suction liner as the screw is rotated counterclockwise.

15 Claims, 10 Drawing Sheets

Portion of Liquid End Assembly Showing Parts of Interest

(51) Int. Cl.

| | |
|---|---|
| ***F04D 29/16*** | (2006.01) |
| ***F04D 29/62*** | (2006.01) |
| ***F04D 29/42*** | (2006.01) |

(56) References Cited

U.S. PATENT DOCUMENTS

| | | | | | |
|---|---|---|---|---|---|
| 2,312,422 | A | | 3/1943 | Kumlin | |
| 3,324,800 | A | * | 6/1967 | Schroeder | 415/128 |
| 3,533,710 | A | * | 10/1970 | Haug | 415/126 |
| 4,120,605 | A | | 10/1978 | Hurst | |
| 4,453,454 | A | | 6/1984 | Comer | |
| 4,560,607 | A | | 12/1985 | Sumner | |
| 4,566,850 | A | | 1/1986 | Grzina | |
| 4,722,664 | A | | 2/1988 | Wissman | |
| 4,802,818 | A | | 2/1989 | Wiggins et al. | |
| 4,913,619 | A | | 4/1990 | Haentjens et al. | |
| 4,932,837 | A | | 6/1990 | Rymal | |
| 4,974,998 | A | | 12/1990 | Heineman | |
| 5,513,954 | A | | 5/1996 | Bourgeois | |
| 5,921,748 | A | | 7/1999 | Frater | |
| 5,941,536 | A | | 8/1999 | Hill | |
| 6,464,454 | B1 | * | 10/2002 | Kotkaniemi | 415/196 |
| 6,582,191 | B2 | | 6/2003 | Addie et al. | |
| 6,893,213 | B1 | | 5/2005 | Quill et al. | |
| 7,563,069 | B2 | | 7/2009 | Harper | |
| 2005/0089397 | A1 | | 4/2005 | Quill et al. | |
| 2008/0152476 | A1 | * | 6/2008 | Melo | 415/93 |
| 2009/0060727 | A1 | | 3/2009 | Moss et al. | |
| 2010/0061514 | A1 | | 3/2010 | Harding | |

OTHER PUBLICATIONS

1 Page English Language Abstract of JP57070997, May 1, 1982.

* cited by examiner

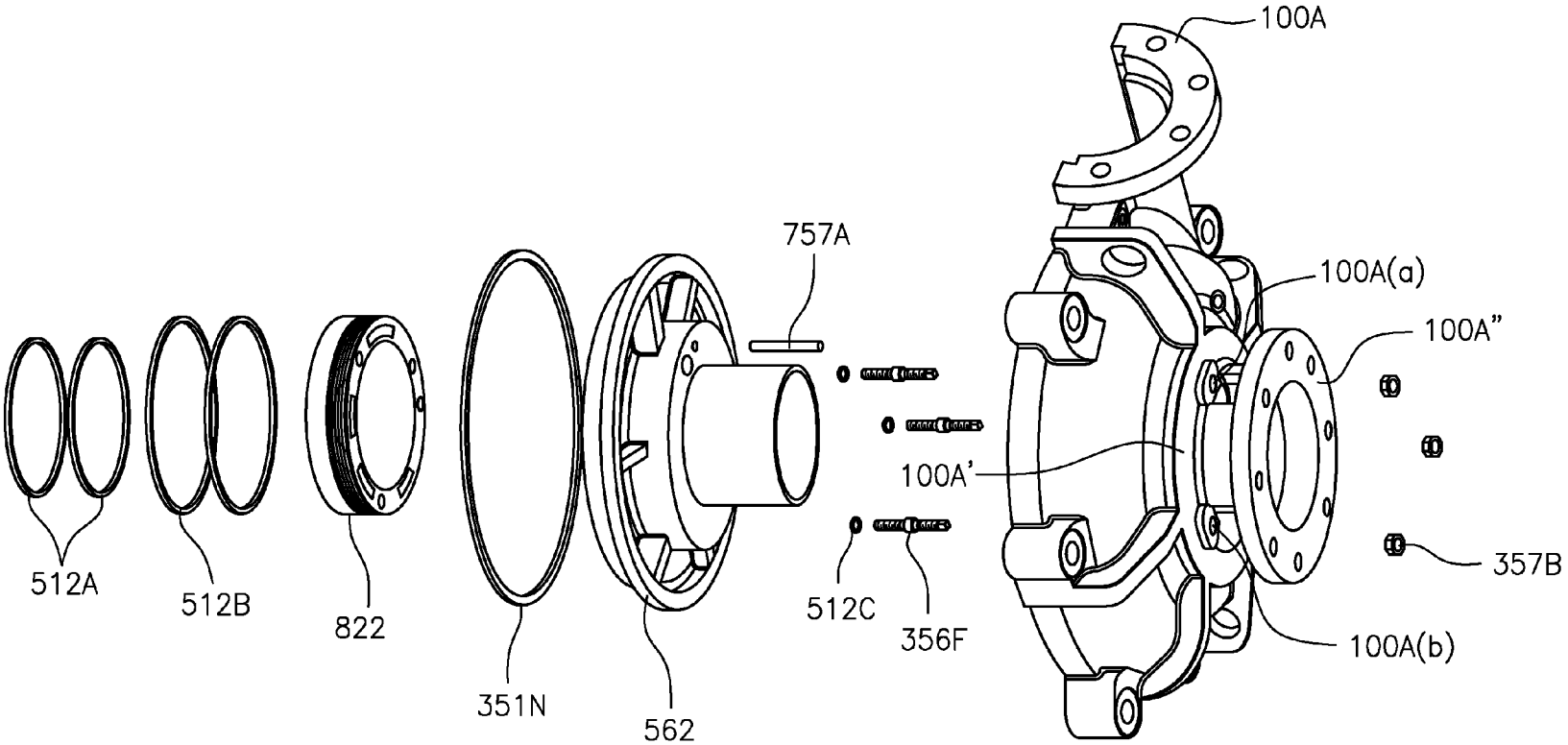
*FIG. 2a*: Portion of Liquid End Assembly Showing Parts of Interest

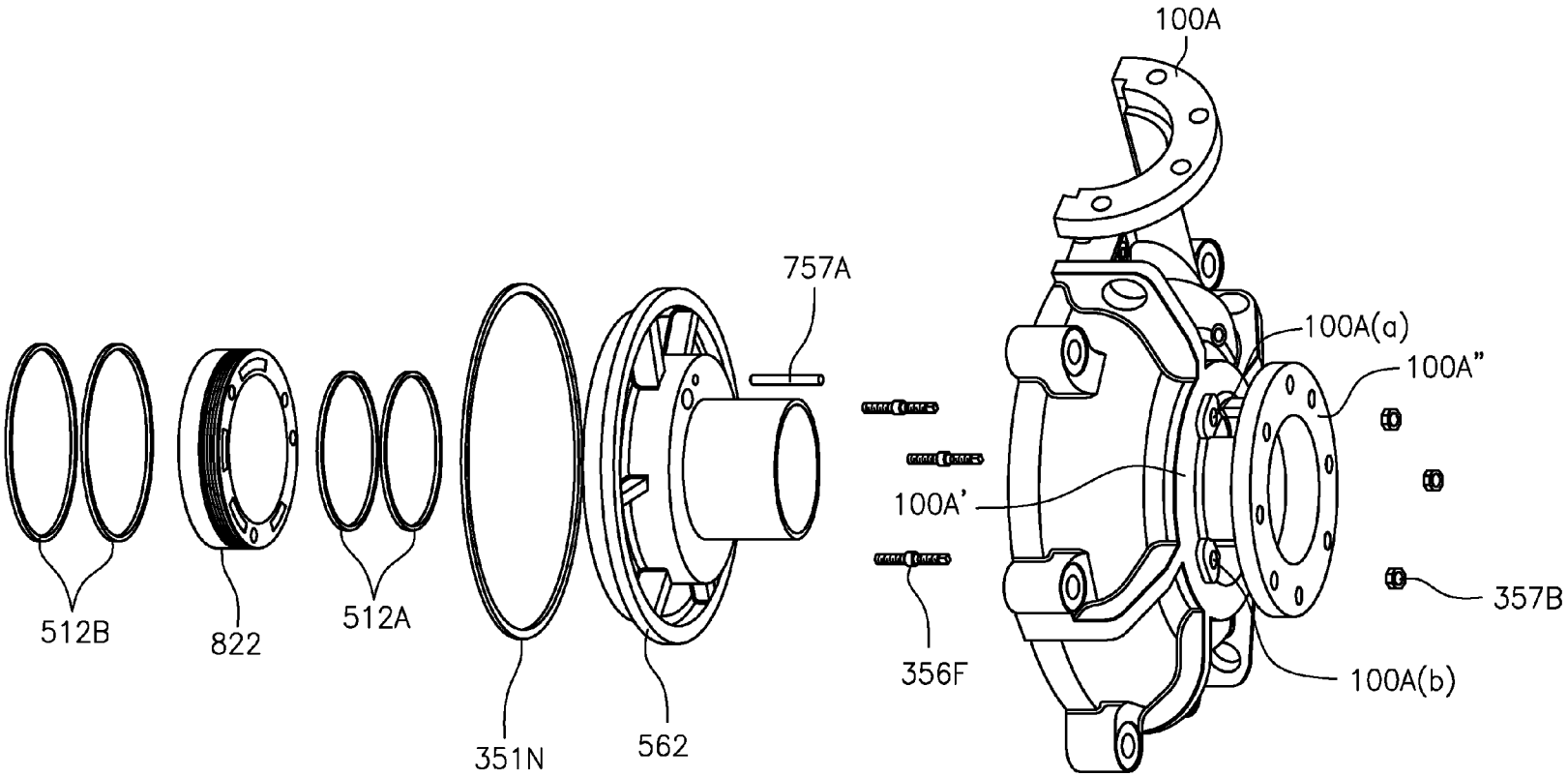
*FIG. 2b*: Portion of Liquid End Assembly Showing Parts of Interest

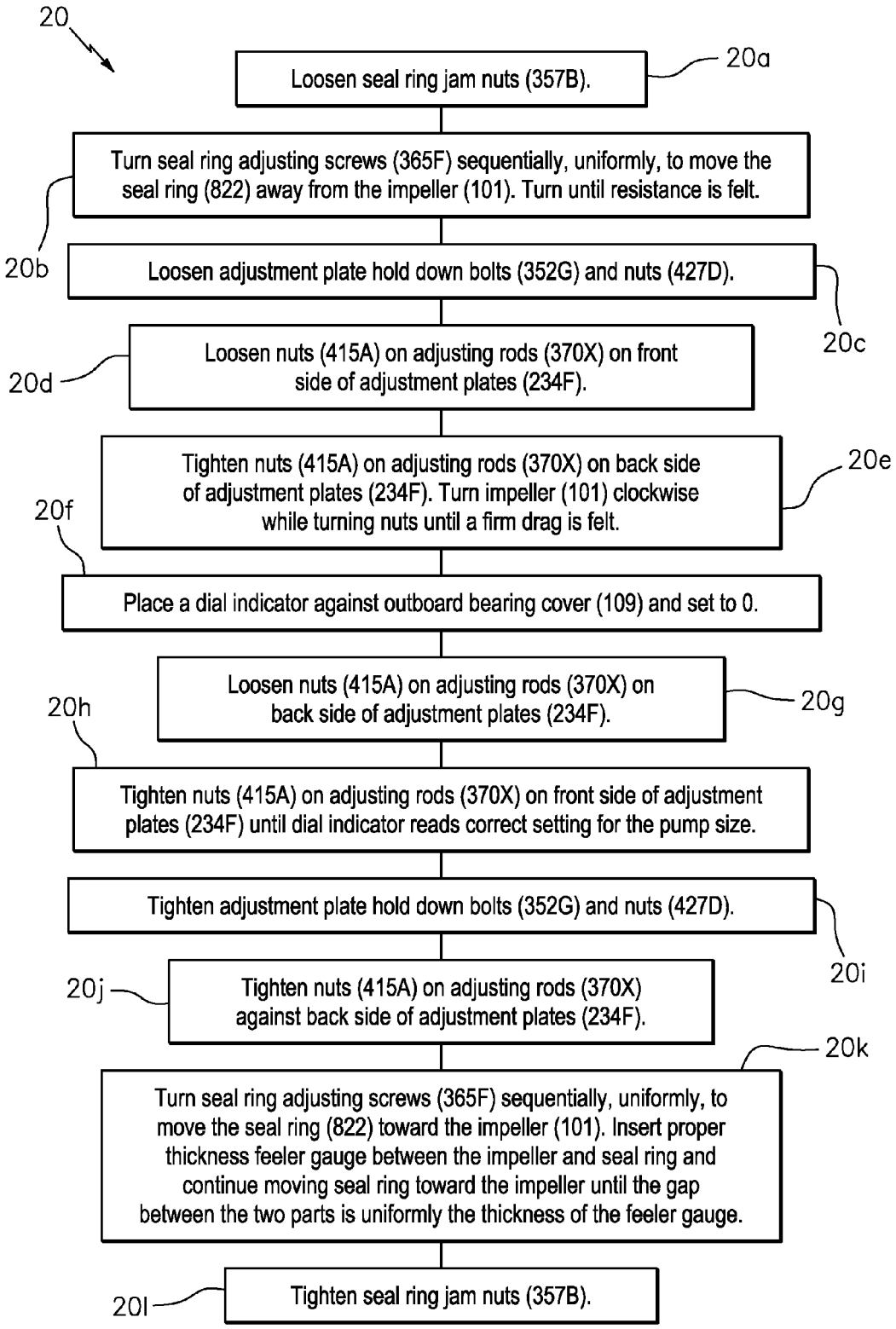
*FIG. 7a*: Impeller/Seal Ring Setting – Version 1

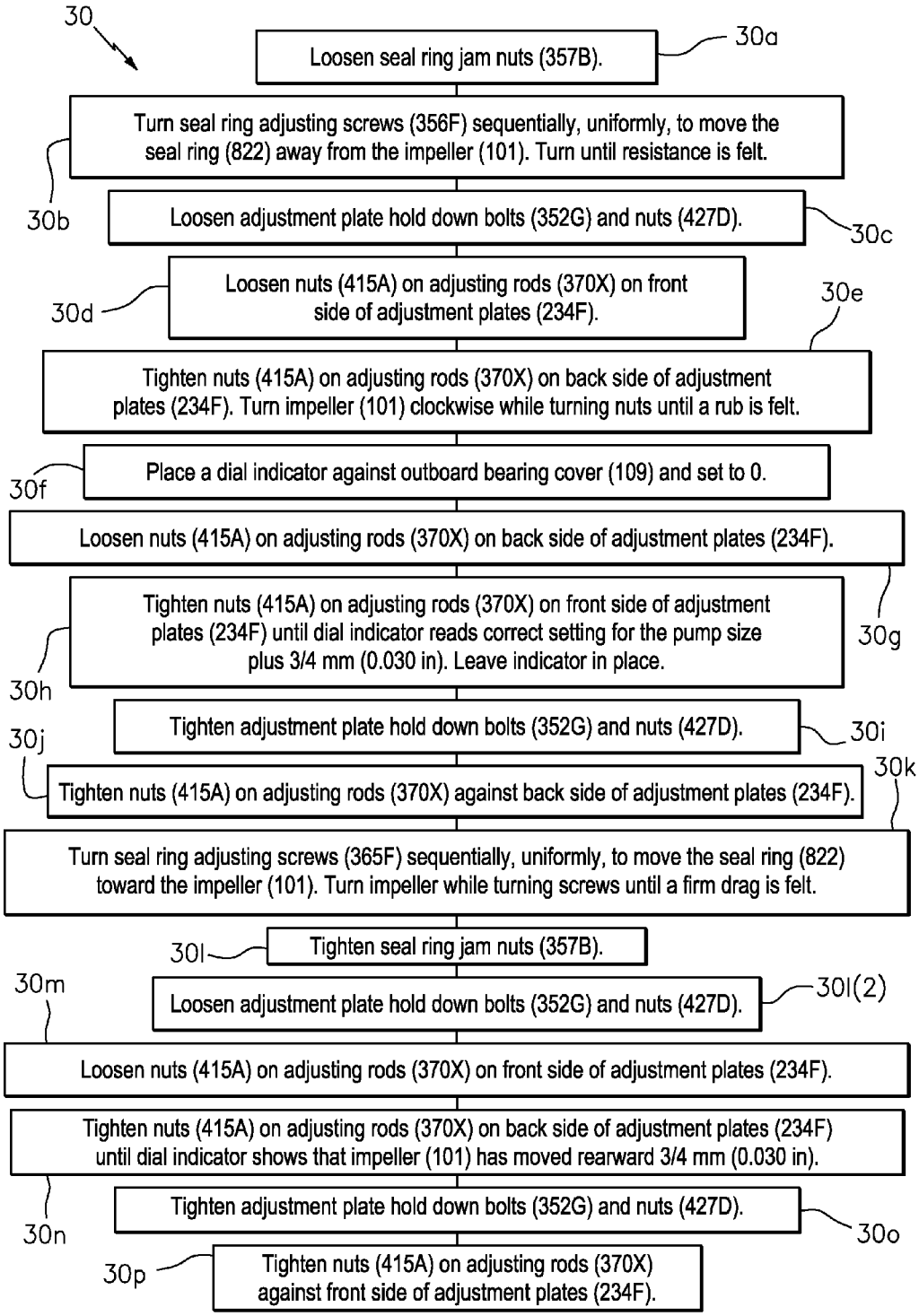
*FIG. 7b*: Impeller/Seal Ring Setting – Version 2

METHOD AND APPARATUS FOR ADJUSTING IMPELLER/RING CLEARANCE IN A PUMP

CROSS REFERENCE TO RELATED PATENT APPLICATION

This application claims benefit to patent application Ser. No. 61/504,008, filed 1 Jul. 2011, which is hereby incorporated by reference in its entirety.

BACKGROUND OF THE INVENTION

1. Field of the Invention

This invention relates to a pump; and more particularly to a technique for adjusting an impeller/ring clearance in a pump.

2. Description of Related Art

As set forth in U.S. Pat. No. 5,921,748, which is hereby incorporated by reference in its entirety, centrifugal pumps are commonly used to pump mixtures of liquids and solids, such as slurry in mineral processing. Particularly in mining, the solid particles of ore in the slurry are highly abrasive. These particles can become trapped between the rotating impeller and the static volute (pump casing) during use, causing wear and abrasion of both the impeller and the volute. This wear reduces the life of the pump and its hydraulic efficiency and leads to greater down-time for repairs.

Conventional centrifugal slurry pumps provide vanes on the gland side of the impeller which reduce the hydraulic pressure at the impeller shaft in order to assist the gland sealing mechanism where the shaft enters the volute. There is normally a small clearance between the vanes and the static volute of the pump. Vanes are also conventionally provided on the suction side of the impeller to discourage slurry from recirculating back into the low pressure suction zone of the pump from the high pressure discharge chamber.

One of the disadvantages of the slurry pumps described above is that the areas between the vanes on the suction side and the gland side of the impeller provide an opening between the impeller and static volute at the periphery of the impeller. Abrasive solid particles from the slurry can enter these spaces and become trapped between the vanes of the impeller and the static volute, causing wear to both the impeller and the volute.

This problem is more prevalent and critical on the suction side of the impeller, where the high pressure liquid inside the discharge portion of the volute tends to flow (through the clearance between the impeller and the static volute) towards the low pressure zone in the suction portion of the pump. Wear on the suction side of the impeller is particularly undesirable, as it causes an increased amount of slurry to recirculate, resulting in a loss of pump hydraulic performance and efficiency. As there is no flow through the gland, wear on the gland side of the impeller is less significant, but still undesirable.

In an attempt to overcome this problem, the casings of some prior art centrifugal pumps are provided with an angled face adjacent to the intake throat of the pump. The angled face of the pump casing is closely aligned with a similar angled face on the suction side of the impeller. Provided a small enough clearance can be achieved between the two angled faces, a degree of sealing can be achieved between the impeller and the casing.

However, because the faces are inclined at an angle to the axis of other than 90 degrees, the faces must be exactly concentric with respect to each other and the axis in order to achieve the desired sealing. Any eccentricity on the part of either the impeller angled face or the casing angled face will impair the seal and allow slurry to recirculate back to the intake, causing wear and loss of pump efficiency.

Further, to adjust the size of the clearance between the two faces, the pump must be shut down and the entire impeller moved towards or away from the casing. This is time consuming and expensive. Also, any wear which may occur will be directly on the impeller or the casing, which are both large and expensive parts to replace.

In order to try to solve this problem, the aforementioned '748 patent discloses an axially adjustable seal ring that mates to the impeller face as one possible technique to solve the aforementioned problem. In particular, the adjustable ring is mounted in said casing to control the clearance between the impeller and the adjustable ring that mates to the impeller face. In the aforementioned '748 patent, the seal ring is adjusted by means of a bolt that pushes the seal ring towards the impeller. If the user turns the bolt too far, the seal ring can rub the impeller, increasing wear. One disadvantage of the technique in the cited '748 patent design is that there is no way to move the seal ring away from the impeller without disassembling the pump.

See also the impeller adjustment method shown in U.S. Pat. No. 6,893,213 B1, which is assigned to the same assignee as the present application, which is also hereby incorporated by reference in its entirety, and which describes other known impeller clearance adjustment techniques. Moreover, other current slurry pump designs are known that adjust the impeller clearance directly against the stationary casing or suction liner.

There is a need in the industry for a better way for adjusting an impeller/ring clearance.

SUMMARY OF THE INVENTION

According to some embodiments, the present invention may take the form of apparatus for adjusting a seal member in relation to an impeller (a.k.a., the impeller/ring clearance) in a pump or pump assembly, arrangement or combination, that may include the following:

a seal member configured with at least two threaded apertures;

a second pump member (e.g., a suction half casing);

a third pump member (e.g., a suction liner) configured between the seal member and the second member; and at least two adjusting screws.

Each adjusting screw may include a first end portion, a second end portion, a third intermediate raised portion between the first end portion and the second end portion, and a fourth portion configured to allow each adjusting screw to be rotated.

Each first end portion may also be configured to pass through a respective aperture in the third member and configured with corresponding threads that couple to, or thread into, a respective threaded aperture of the seal member.

Each second end portion may be configured to pass through a respective aperture of the second member to allow the fourth portion to be accessed so each adjusting screw may be rotated.

In order to adjust the seal member in relation to the impeller (a.k.a., the impeller/ring clearance) in one direction, each adjusting screw may also be configured to be rotated in one rotational direction and moved in one axial direction until the third intermediate raised portion pushes against one of the second member or the third member, causing the adjusting screw to stop moving in the one axial direction, and the seal member to move in an opposite axial direction in relation to an impeller as the adjusting screw continues to be rotated in the one rotational direction.

Alternatively, in order to adjust the impeller/ring clearance in the other direction, each adjusting screw may also be configured to be rotated in an opposite rotational direction and moved in the opposite axial direction until the third intermediate raised portion of the adjusting screw pushes against the other of the second member or the third member, causing the adjusting screw to stop moving in the opposite axial direction, and the seal member to move in the one axial direction in relation to the impeller as the adjusting screw continues to be rotated in the opposite rotational direction.

According to some embodiments, the present invention may also include one or more of the following features:

The apparatus may take the form of the pump or pump assembly, arrangement or combination; the seal member may take the form of a seal ring in the pump, or pump assembly, arrangement or combination; the second member may take the form of a suction half casing of a two-part casing in the pump or pump assembly, arrangement or combination; and the third member may take the form of a suction liner in the pump or pump assembly, arrangement or combination.

The at least two threaded apertures in the seal member may be configured with left-handed threads. In this embodiment, each adjusting screw may be configured to be rotated clockwise and moved axially until the third raised intermediate portion of the adjusting screw pushes against a suction half casing, causing the adjusting screw to stop moving axially, and the seal member to move away from the suction liner and towards the impeller as the adjusting screw continues to be rotated clockwise. In this embodiment, each adjusting screw may also be configured to be rotated counterclockwise and moved axially until the third raised intermediate portion pushes against a suction liner, causing the adjusting screw to stop moving axially, and the seal member to move towards the suction liner and away from the impeller as the adjusting screw continues to be rotated counterclockwise.

Alternatively, the at least two threaded apertures may be configured with right-handed threads. In this embodiment, each adjusting screw may be configured to be rotated clockwise and moved axially until the third raised intermediate portion of the adjusting screw pushes against the suction liner, causing the adjusting screw to stop moving axially, and the seal member to move towards the suction liner and away from the impeller as the adjusting screw continues to be rotated clockwise. In this embodiment, each adjusting screw may also be configured to be rotated counterclockwise and moved axially until the third raised intermediate portion pushes against a suction half casing, causing the adjusting screw to stop moving axially, and the seal member to move away from the suction liner and towards the impeller as the adjusting screw continues to be rotated counterclockwise.

The fourth portion of the adjusting screw may also be configured with a triangular, square, pentagonal or hex head portion to be engaged by a tool having a corresponding geometric shape. The fourth portion of the adjusting screw may also be configured with a head portion having other types or kinds of geometric configurations either now known or later developed in the future to be engaged by a corresponding tool having a corresponding geometric shape, including a standard screwdriver groove, channel, indentation, as well as a head portion having, e.g., 12 axial grooves (i.e., a Ferry head).

By way of example, the at least two threaded apertures of the seal ring may comprise three threaded apertures, e.g., spaced equidistant in relation to one another (i.e. about 120° apart.). In this embodiment, the at least two adjusting screws may take the form of three adjusting screws.

The apparatus may also comprise a seal ring nut having threads, and each second portion of each adjusting screw may be configured with corresponding threads to receive the threads of the seal ring nut and lock the adjusting screw in relation to the second member, e.g., the suction half casing.

A face of the suction half casing may also be configured with indicia, including the wording "IN" and/or an arrow, to indicate the direction the adjusting screw should be rotated to move the seal ring in towards the impeller, e.g. by either casting the indicia into the face of the suction half casing, or affixing a label containing the indicia onto the face of the suction half casing.

In one particular embodiment, the present invention may take the form of a pump assembly, arrangement or combination featuring the following:

a seal ring configured with at least three left-handed threaded apertures;

a suction half casing;

a suction liner configured between the seal ring and the suction half casing; and at least three adjusting screws.

Each adjusting screw may be configured with a first end portion, a second end portion, a third intermediate raised portion between the first end portion and the second end portion, and a fourth portion configured to allow each adjusting screw to be rotated clockwise or counterclockwise.

Each first end portion may also be configured to pass through a respective aperture of the suction liner and configured with corresponding left-handed threads that couple to a respective left-handed aperture of the seal ring.

Each second portion may be configured to pass through a respective aperture of the suction half casing to allow the fourth portion to be accessed to allow each adjusting screw to be rotated clockwise or counterclockwise.

In order to adjust the impeller/ring clearance in one direction, each adjusting screw may be configured to be rotated clockwise and moved axially until the third intermediate raised portion pushes against the suction half casing, causing the adjusting screw to stop moving axially and the seal ring to move away from the suction liner and towards the impeller as the adjusting screw continues to be rotated clockwise.

Alternatively, in order to adjust the impeller/ring clearance in the other direction, each adjusting screw may be configured to be rotated counterclockwise and moved axially until the third intermediate raised portion of the adjusting screw pushes against the suction liner, causing the adjusting screw to stop moving axially and the seal ring to move towards the suction liner and away from the impeller as the adjusting screw continues to be rotated counterclockwise.

This embodiment may be further configured to include one or more of the other features set forth above.

In effect, the improvement that characterizes the present invention uses, or takes advantage of, concepts derived from the impeller adjustment method shown in U.S. Pat. No. 6,893,213 B1, which is assigned to the same assignee as the present application. In its current form, it differs from that disclosed in the '213 patent in that it:

adjusts a ring rather than an entire bearing assembly, is installed in relation to the suction half casing rather than in a bearing frame, and incorporates both conventional coarse right-hand threads on the one outer portion and fine left-hand threads on the other outer portion that actually adjusts the seal ring.

Furthermore, during testing of prototype parts, it became evident to the present inventors that how to use the adjusting screw to set the clearance between the seal ring and the impeller was not an inherently obvious problem to be solved. For example, it appeared that there was potential for the adjusting screw to bind, seize, or otherwise hang up in the seal ring due to over tightening, non-uniform tightening, galling, corrosion and/or infiltration of solid particles as encountered in slurry applications.

In order to make the adjusting screw more "user-friendly" and easier for the user to understand, e.g., the direction of the threads was changed to left-hand and included lettering on the suction half casing that indicates the direction that the screw should be turned to advance the seal ring in. If it is desired to pull the ring back, the screw would be turned in the opposite direction.

Because the ring may be made of a much harder material than the adjusting screw, in the event that the screw "seizes" in the ring, it is more likely to be damaged than is the seal ring. While disassembly may still be required, it would be much less costly to replace the adjusting screw than it would be to replace the seal ring.

The likelihood of galling or otherwise seizing the screw in the ring is reduced by use of fine threads. It is also advantageous for a finer adjustment of the clearance than is a coarse thread.

An O-ring may be added over the adjusting screw to reduce the infiltration of liquids that could cause corrosion and solids that could collect in the threads and cause galling and/or seizing.

Method Claims

The present invention may also take the form of a method for adjusting a seal ring in relation to an impeller in a pump assembly, arrangement or combination featuring the following steps:

arranging a seal ring configured with at least three left-handed threaded apertures in relation to a suction half casing and a suction liner so that the suction liner is configured between the seal ring and the suction half casing;

providing at least three adjusting screws, each adjusting screw having a first end portion, a second end portion, a third intermediate raised portion between the first end portion and the second end portion, and a fourth portion configured to allow each adjusting screw to be rotated clockwise or counterclockwise, each first end portion passing through a respective aperture of the suction liner and having corresponding left-handed threads that couple to a respective left-handed aperture of the seal ring, and each second portion passing through a respective aperture of the suction half casing to allow the fourth portion to be accessed to allow each adjusting screw to be rotated clockwise or counterclockwise; and adjusting the seal ring in relation to the impeller by performing at least one of the following steps:

either rotating each adjusting screw clockwise so as to move axially until the third intermediate raised portion pushes against the suction half casing, causing each adjusting screw to stop moving axially and the seal ring to move away from the suction liner and towards the impeller as the adjusting screw continues to be rotated clockwise until an adjustment is complete, or rotating each adjusting screw counterclockwise so as to move axially until the third intermediate raised portion of the adjusting screw pushes against the suction liner, causing the adjusting screw to stop moving axially and the seal ring to move towards the suction liner and away from the impeller as the adjusting screw continues to be rotated counterclockwise until the adjustment is complete.

These and other features, aspects, and advantages of embodiments of the invention will become apparent with reference to the following description in conjunction with the accompanying drawing. It is to be understood, however, that the drawing is designed solely for the purposes of illustration and not as a definition of the limits of the invention.

BRIEF DESCRIPTION OF THE DRAWING

The drawing, which is not necessarily to scale, includes the following Figures:

FIG. 2*a* is an illustration of parts of apparatus for adjusting an impeller/ring clearance according to some embodiments of the present invention.

FIG. 2*b* is an illustration of parts of apparatus for adjusting an impeller/ring clearance according to some embodiments of the present invention.

FIG. 7*a* is a flowchart of steps for setting the impeller seal ring clearance using the apparatus for adjusting an impeller/ring clearance according to some embodiments of the present invention.

FIG. 7*b* is a flowchart of steps for setting the impeller seal ring clearance using the apparatus for adjusting an impeller/ring clearance according to some embodiments of the present invention.

In the following description of the exemplary embodiment, reference is made to the accompanying drawing, which forms a part hereof, and in which is shown by way of illustration of an embodiment in which the invention may be practiced. It is to be understood that other embodiments may be utilized, as structural and operational changes may be made without departing from the scope of the present invention.

DETAILED DESCRIPTION OF THE INVENTION

FIG. 1

Figure 1:
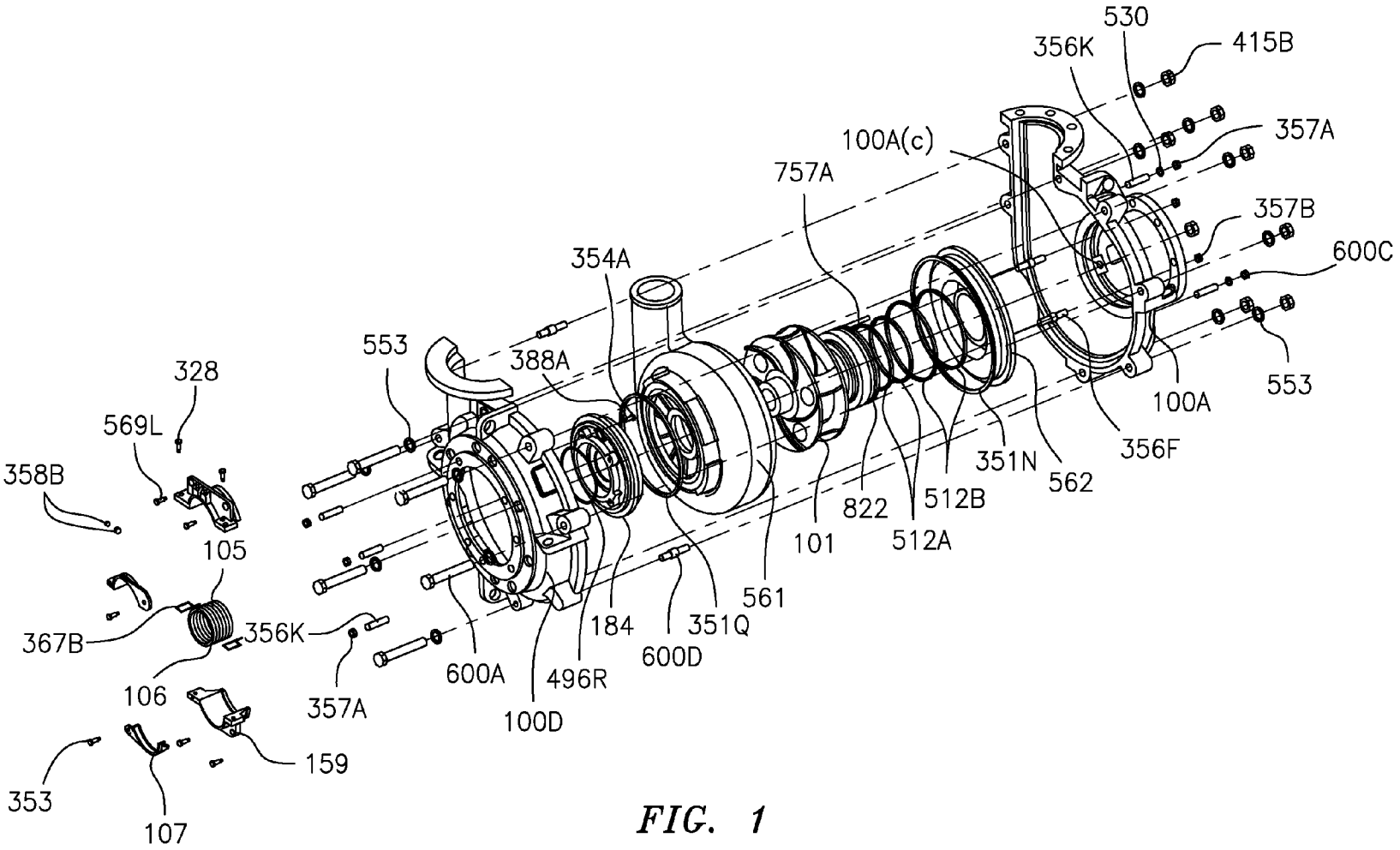
FIG. 1 is an illustration of parts in a pump arrangement or combination that includes apparatus for adjusting an impeller/ring clearance according to some embodiments of the present invention.

FIG. 1 illustrates the liquid end of a slurry pump of the assignee of the present application. The liquid end of the slurry pump is shown and described in relation to other inventions set forth in other patent applications, including patent application Ser. No. 13/187,766, filed 21 Jul. 2012; patent application Ser. No. 13/186,647, filed 20 Jul. 2012; and U.S. Pat. No. 8,979,476, which corresponds to patent application Ser. No. 13/187,964, filed 21 Jul. 2012, which are all assigned to the assignee of this application, and which are all incorporated in their entirety by reference.

Table A below is a parts list of the liquid end of the slurry pump shown in FIG. 1.

Table A with Parts List

| Reference No. | Part Name |
|---|---|
| 100A | Suction Half Casing |
| 100D | Gland Half Casing |
| 101 | Impeller |
| 105 | Lantern Ring |
| 106 | Packing |
| 107 | Gland Half |
| 159 | Chamber, Split Packing Assembly |
| 184 | Cover, Seal |
| 328 | Bolt, Hex Shoulder |
| 351N | Gasket, Volute Liner to Suction Side Liner |
| 351Q | Gasket, Seal Cover to Volute Liner |
| 353 | Screw, Hex Cap (gland adjusting) |
| 354A | Washer, Clipped (seal cover retention) |
| 356F | Adjusting Screw or Bolt, Square Head (seal ring) |
| 356K | Stud, Volute Liner Retention |
| 357A | Nut, Hex (volute liner retention) |
| 357B | Nut, Hex Jam, (seal ring) |
| 358B | Plug, Pipe (chamber) |
| 367B | Gasket, Chamber |
| 388A | Screw, Socket Head (seal cover retention) |
| 415B | Nut, Hex (taper stud, casing alignment) |
| 496R | O-Ring, Chamber |
| 512A | O-Ring, Seal Ring ID |
| 512B | O-Ring, Seal Ring OD |
| 512C | O-Ring, Adjusting Screw or Bolt (seal ring), optional |
| 530 | Washer, Plain (suction side liner) |
| 553 | Washer, Plain (casing) |
| 561 | Volute Liner, Casing |
| 562 | Suction Liner |
| 569L | Screw, Hex Cap (chamber to cover) |
| 600A | Screw, Hex Cap (casing) |
| 600C | Nut, Hex (casing) |
| 600D | Taper Stud, Casing Alignment |
| 757A | Roll Pin, Seal Ring Indicator |
| 822 | Seal Ring |

FIGS. 2*a* and 2*b* show the suction half casing 100A and the suction liner 562 arranged in relation to the seal ring 822 without many of the other parts shown in FIG. 1. In FIG. 2*a*, seal ring ID and OD O-rings 512A and 512B are illustrated on the left side of the seal ring 822. In FIG. 2*b*, seal ring ID O-ring 512A is illustrated on the right side of the seal ring 822, and seal ring OD O-ring 512B is illustrated on the left side of the seal ring 822. The scope of the invention is not intended to be limited to how the seal ring ID and OD O-rings 512A and 512B are illustrated in relation to the seal ring 822 in FIGS. 2*a* and 2*b*.

FIG. 3

Figure 3:
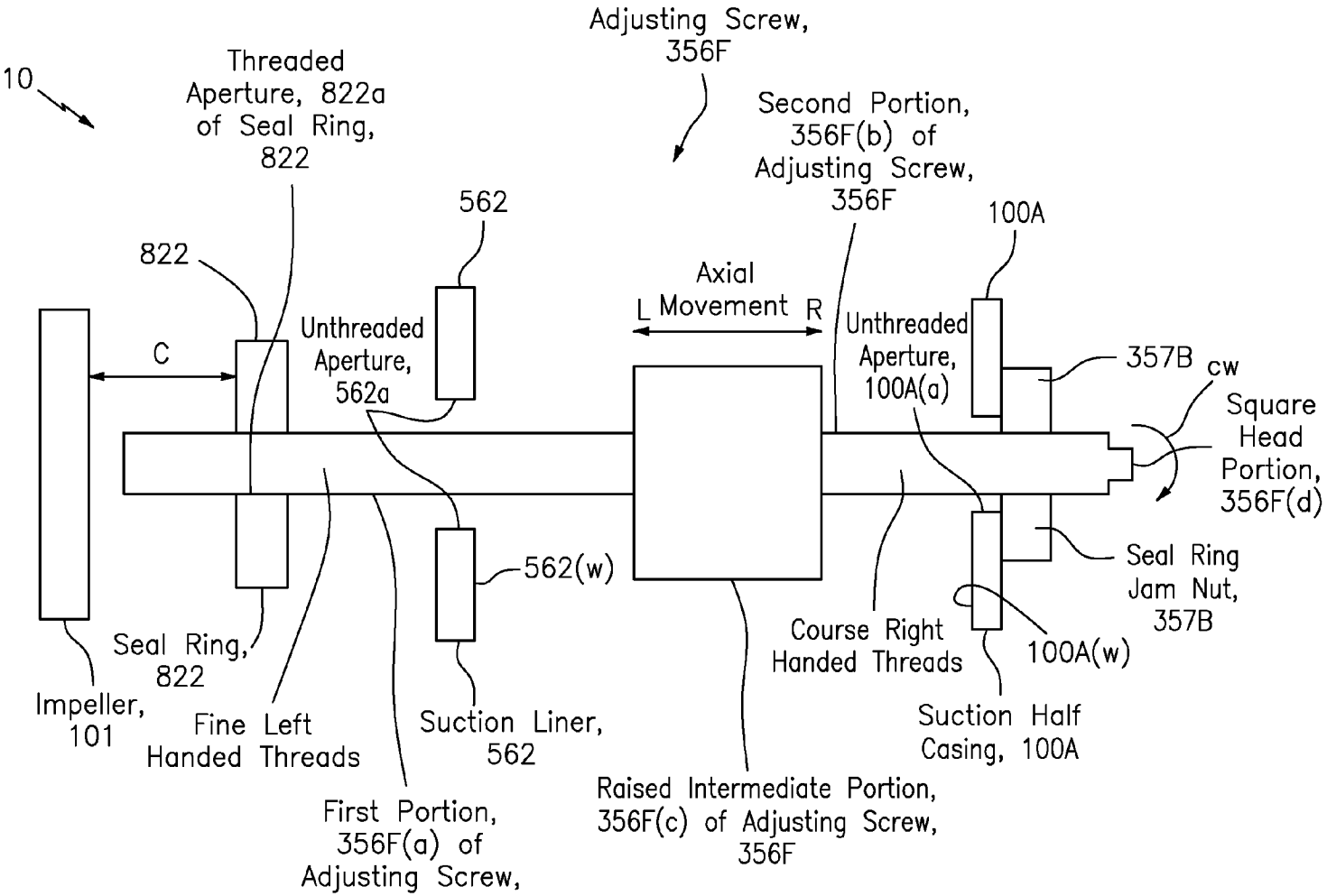
FIG. 3 is an illustration in block diagram form of parts of apparatus for adjusting an impeller/ring clearance according to some embodiments of the present invention.

FIG. 3 shows, in block diagram form, parts of apparatus generally indicated as 10 for adjusting an impeller/ring clearance generally indicated as C according to some embodiments of the present invention. In FIG. 3, the apparatus 10 may be configured to include a seal ring 822 (see also FIGS. 1, 2*a*, 2*b*, 5*a*, 5*b*), a suction half casing 100A (see also FIGS. 1, 2*a*, 2*b*); a suction liner 562 (see also FIGS. 1, 2*a*, 2*b*, 6*a*, 6*b*, 6*c*) and three adjusting screws 356F (see also FIGS. 1, 2*a*, 2*b*, 4*a* to 4*e*). FIG. 3 also shows the impeller 101 (see also FIG. 1) in block form in relation to the seal ring 822, as well as the impeller/ring clearance C generally defined between these two elements that is determined at least partly by the impeller/ring adjustment according to the present invention.

Figure 5B:
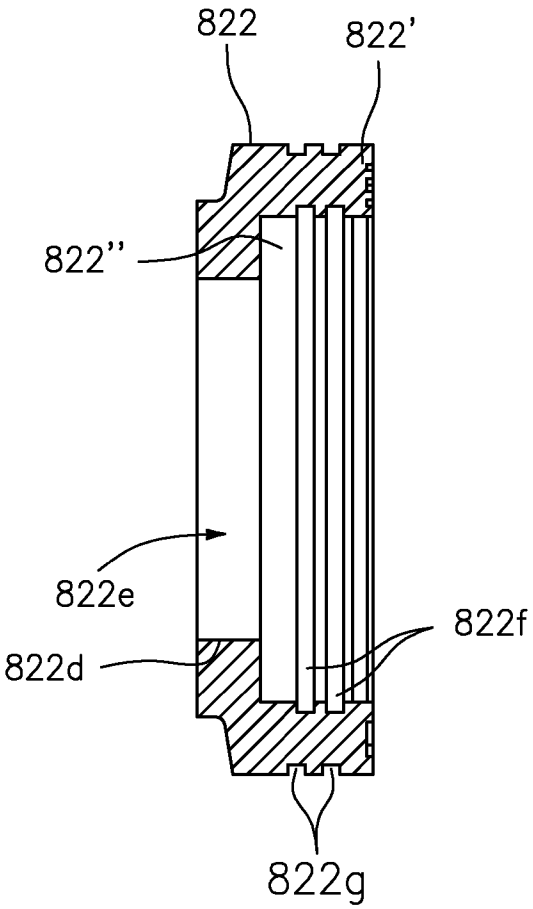
FIG. 5*b* is a front sectional view along lines 5*b*-5*b* (FIG. 5*a*) of the seal ring shown in FIG. 5*a* according to some embodiments of the present invention.
Figure 5A:
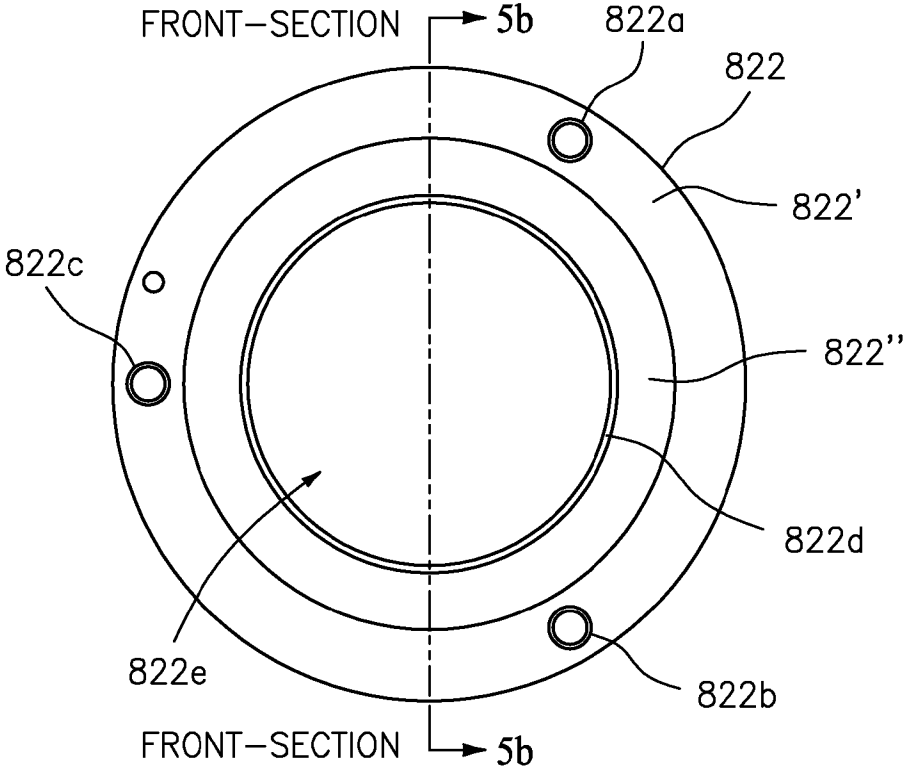
FIG. 5*a* is a top-down view that formed part of a manufacturing drawing showing a seal ring according to some embodiments of the present invention.

The seal ring 822 may be configured with an outer rim portion 822' having three left-handed threaded apertures 822*a*, 822*b*, 822*c* shown in FIG. 5*a*, e.g. spaced circumferentially about 120° apart. The scope of the invention is not intended to be limited to the number of threaded apertures or any particular angular spacing thereof. For example, embodiments of the present invention are envisioned using more apertures or fewer apertures, e.g., including two apertures or four or more apertures. In FIG. 3, one of the three left-handed threaded apertures 822*a*, 822*b*, 822*c* is shown, and indicated by way of example as, left-handed threaded aperture 822*a*.

The suction half casing 100A may be configured with an inner portion 100A' and an outer rim portion 100A" as shown in FIGS. 2*a*, 2*b*. The inner portion 100A' may be configured with three unthreaded apertures, including apertures indicated as 100A(a) and 100A(b) shown in FIGS. 2*a* and 2*b* and a third unthreaded aperture 100A(c) shown in FIG. 1, e.g. spaced circumferentially about 120° apart. The three unthreaded apertures 100A(a), 100A(b), 100A(c) of the suction half casing 100A correspond to the three left-handed threaded apertures 822*a*, 822*b*, 822*c* of the seal ring 822. In FIG. 3, one of the three unthreaded apertures 100A(a), 100A(b), 100A(c), is shown, and indicated by way of example as, aperture 100A(a).

As shown in FIG. 3, the suction liner 562 may be configured between the seal ring 822 and the suction half casing 100A (see also FIGS. 1, 2*a*, 2*b*). The suction liner 562 may be configured to include an inner rim portion 562' having three unthreaded apertures 562*a*, 562*b*, 562*c* as shown in FIG. 6*b*, e.g. spaced circumferentially about 120° apart. The three unthreaded apertures 562*a*, 562*b*, 562*c* of the suction liner 356 correspond to the three left-handed threaded apertures 822*a*, 822*b*, 822*c* of the seal ring 822 and the three unthreaded apertures 100A(a), 100A(b), 100A(c) of the suction half casing 100A. In FIG. 3, one of the three unthreaded apertures 562*a*, 562*b*, 562*c* is shown, and indicated by way of example, as aperture 562*a*.

Each adjusting screw 356F of the three adjusting screws 356F may be configured with a first end portion 356F(a), a second end portion 356F(b), a third intermediate raised portion 356F(c) between the first end portion 356F(a) and the second end portion 356F(b), and a fourth portion 356F(d)

configured to allow each adjusting screw 356F to be rotated clockwise or counterclockwise. Each first end portion 356F (a) may also be configured to pass through a respective aperture 562*a* of the suction liner 562 and configured with corresponding left-handed threads that couple to, and thread into, a respective left-handed aperture 822*a* of the seal ring 822. Each second portion 356F(b) may be configured to pass through a respective aperture 100A(a) of the suction half casing 100A to allow the fourth portion 356F(d) to be accessed to allow each adjusting screw 356F to be rotated clockwise as shown by the arrow in FIG. 3, or counterclockwise (in the opposite rotational direction to the arrow shown in FIG. 3).

In order to adjust the impeller/ring clearance in one direction, each adjusting screw 356F may be configured to be rotated clockwise (CW) and moved axially (rightwardly R as shown in FIG. 3) until the third intermediate raised portion 356F(c) pushes against an inner wall portion 100A(w) of the suction half casing 100A, causing the adjusting screw 356F to stop moving axially and the seal ring 822 to move away (leftwardly L as shown in FIG. 3) from the suction liner 562 and towards the impeller 101 (see also FIG. 1) as the adjusting screw 356F continues to be rotated clockwise.

Alternatively, in order to adjust the impeller/ring clearance in the other direction, each adjusting screw 356F may be configured to be rotated counterclockwise and moved axially (leftwardly L as shown in FIG. 3) until the third intermediate raised portion 356F(c) of the adjusting screw 356F pushes against a wall portion 562(*w*) the suction liner 562, causing the adjusting screw 356F to stop moving axially and the seal ring 822 to move towards (rightwardly R as shown in FIG. 3) the suction liner 562 and away from the impeller 101 (see also FIG. 1) as the adjusting screw 356F continues to be rotated counterclockwise.

The fourth portion 356F(d) of the adjusting screw 356F may be configured with a triangular, square (see FIGS. 1, 2*a*, 2*b*, 3, 4*a* to 4*c*), pentagonal or hex shaped head portion to be engaged by a tool (not shown) having a corresponding geometric shape. The fourth portion 356F(d) of the adjusting screw 356F may also be configured with a head portion having other types or kinds of geometric configurations either now known or later developed in the future to be engaged by a corresponding tool having a corresponding geometric shape, including a standard screwdriver groove or indentation, as well as a head portion having, e.g., 12 axial grooves (i.e., a Ferry head), within the spirit of the underlying invention.

By way of example, threaded apertures of the seal ring 822 in FIG. 5*a* are shown as the three threaded apertures 822*a*, 822*b*, 822*c* that are spaced equidistant in relation to one another (i.e. about 120° apart). However, embodiments of the present invention are envisioned using as few as two threaded apertures, e.g., spaced about 180° apart (i.e. diametrically opposed) from one another. In addition, embodiments of the present invention are also envisioned using four threaded apertures, e.g., spaced about 90° apart. Moreover, embodiments of the present invention are also envisioned using five threaded apertures, e.g., spaced about 72° apart. In each of these cases, a corresponding number of adjusting screws 356F would be used, as well as the suction liner 562 and the suction half casing 100A having a corresponding number of apertures through which the adjusting screws 356F would be passed.

Figure 4A:
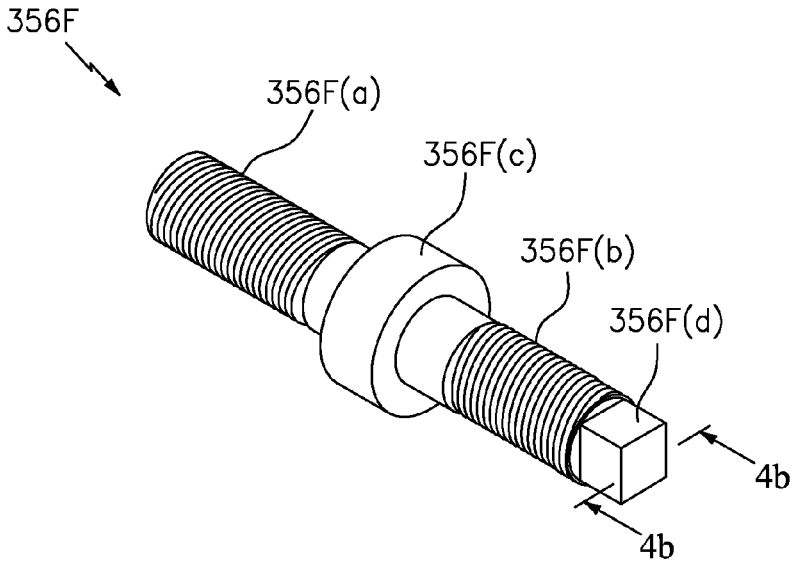
FIG. 4*a* is a perspective view that formed part of a manufacturing drawing showing an adjusting screw for the apparatus for adjusting an impeller/ring clearance according to some embodiments of the present invention.
Figure 4B:
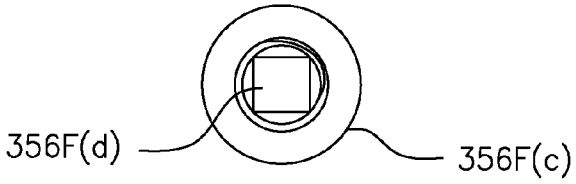
FIG. 4*b* is a longitudinal view along lines 4*b*-4*b* (FIG. 4*a*) of the adjusting screw shown in FIG. 4*a* according to some embodiments of the present invention.
Figure 4C:
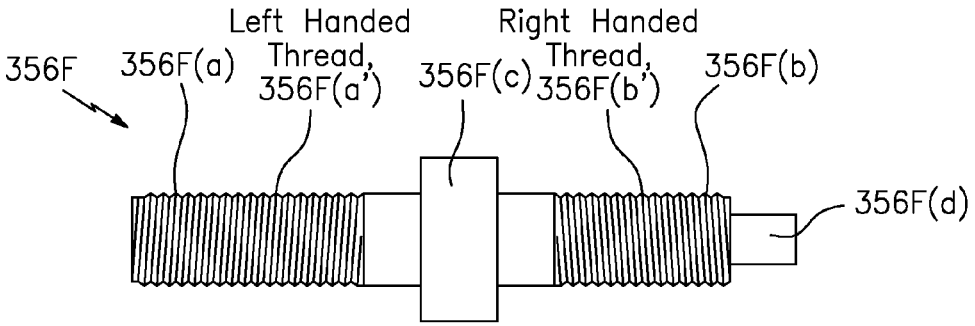
FIG. 4*c* is a top-down view that formed part of a manufacturing drawing showing an adjusting screw for the apparatus for adjusting an impeller/ring clearance according to some embodiments of the present invention.
Figure 4D:
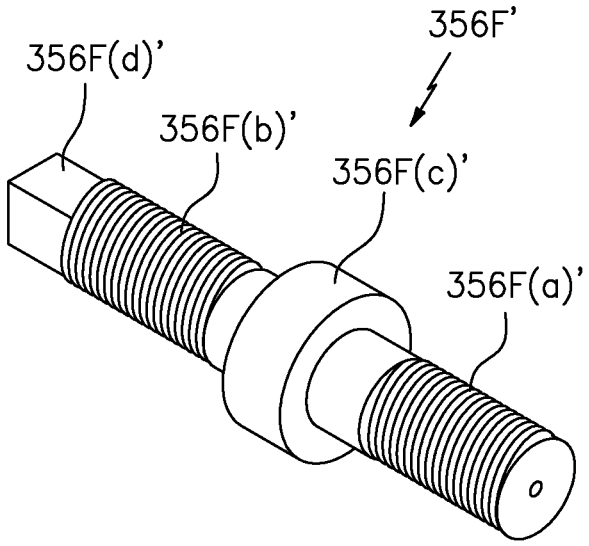
FIG. 4*d* is a perspective view that formed part of a manufacturing drawing showing an adjusting screw for the apparatus for adjusting an impeller/ring clearance according to some embodiments of the present invention.
Figure 4E:
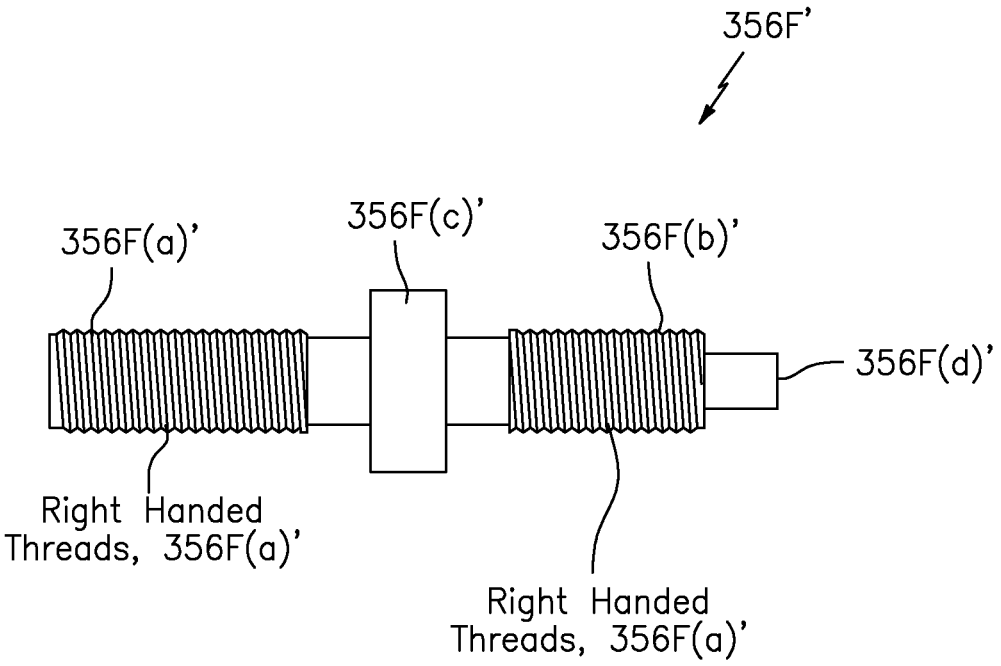
FIG. 4*e* is a top-down view that formed part of a manufacturing drawing showing an adjusting screw for the apparatus for adjusting an impeller/ring clearance according to some embodiments of the present invention.

The apparatus 10 may also comprise a seal ring jam nut 357B (e.g., see FIGS. 1, 2*a*, 2*b* and 3) having threads, and each second portion 356F(b) of each adjusting screw 356F may be configured with corresponding threads 356F(b') in FIG. 4*c*, or 356F(a')' in FIG. 4*e*, to receive the threads of the seal ring nut 357B and lock the adjusting screw 356F in relation to the suction half casing 100A after the impeller/ring clearance adjustment has been made.

FIGS. 4*a* Through 4*e*

FIGS. 4*a*, 4*b*, 4*c* show the adjusting screw 356F according to some embodiments of the present invention, including the first portion 356F(a), the second portion 356F(b), the third intermediate raised portion 356F(c) and the fourth portion 356F(d). FIG. 4*c* shows the left-handed threads 356F(a') of the first portion 356F(a) and shows the right-handed threads 356F(b') of the second portion 356F(b). The scope of the invention is not intended to be limited to any particular dimensions.

FIGS. 4*d*, 4*e* show an adjusting screw 356F' according to some embodiments of the present invention, including a first portion 356F(a)', a second portion 356F(b)', a third intermediate raised portion 356F(c)' and a fourth portion 356F(d)'. FIG. 4*e* shows right-handed threads 356F(a')' on both the first portion 356F(a)' and the second portion 356F(b)', according to some embodiments of the present invention. The scope of the invention is not intended to be limited to any particular dimensions, or thread pitches, etc.

FIGS. 5*a*, 5*b*: Seal Ring 822

In addition to that set forth above, the seal ring 822 may also be configured with an inner rim portion 822" having an inner rim 822*d* configured to form a circular opening generally indicated as 822*e* in FIGS. 5*a* and 5*b*. As shown in FIGS. 5*a*, 5*b*, the seal ring 822 may also be configured to include other features that do not form part of the underlying invention, such as one or more inner annular grooves 822*f* and one or more outer annular grooves 822*g*, e.g., configured to receive O-rings, like elements 512A and 512B in FIGS. 1, 2*a* and 2*b*.

Figure 6C:
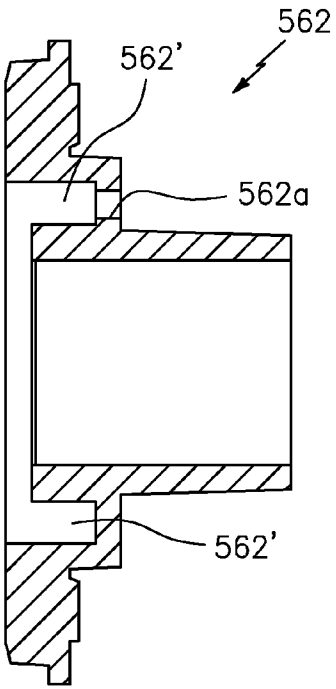
FIG. 6*c* is a sectional view along lines 6*c*-6*c* (FIG. 6*b*) of the suction liner in FIG. 6*b* according to some embodiments of the present invention.
Figure 6B:
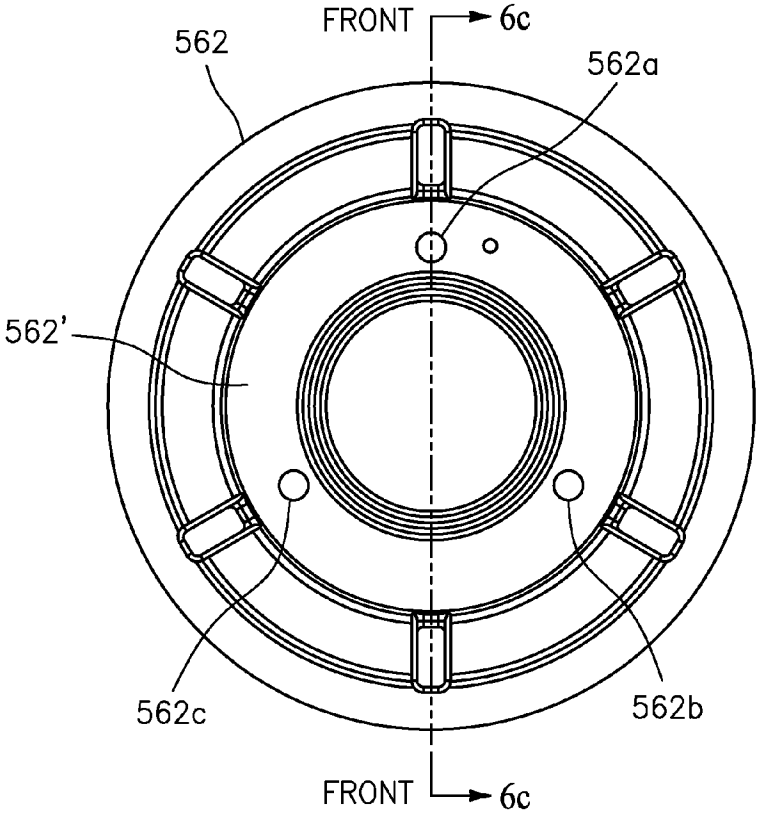
FIG. 6*b* is a top-down view that formed part of a manufacturing drawing showing a suction liner according to some embodiments of the present invention.
Figure 6A:
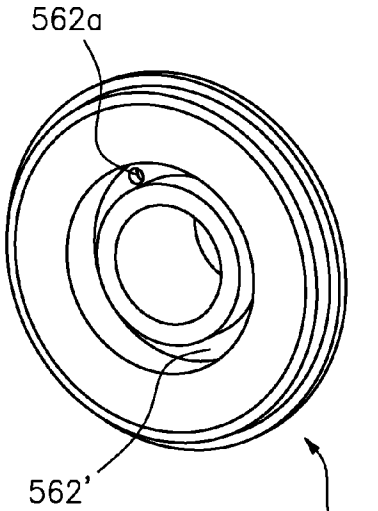
FIG. 6*a* is a perspective view that formed part of a manufacturing drawing showing a suction liner for the apparatus for adjusting an impeller/ring clearance according to some embodiments of the present invention.

FIGS. 6*a*, 6*b*, 6*c*: Suction Liner 562

In addition to that set forth above, in FIGS. 6*a*, 6*c* the inner rim portion 562' of the suction liner 562 may be configured as an annular channel, e.g., to receive a portion of the seal ring 822, as best shown in relation to FIGS. 1, 2*a*, 2*b*.

FIGS. 7*a* and 7*b*: Flowcharts for Impeller/Seal Ring Setting

In FIGS. 7*a*, a flowchart generally indicated as 20 includes steps 20*a*, 20*b*, 20*c*, . . . , 20*l* for setting the impeller/ring clearance using the apparatus for adjusting an impeller/ring clearance disclosed herein.

In FIGS. 7*b*, a flowchart generally indicated as 30 includes steps 30*a*, 30*b*, 30*c*, . . . , 30*p* for setting the impeller seal ring clearance using the apparatus for adjusting an impeller/ring clearance according to some embodiments of the present invention.

The flowcharts 20 (FIGS. 7*a*) and 30 (FIG. 7*b*) reference other parts of the pump, pump assembly, arrangement or combination, and the reader is referred to the aforementioned patent application Ser. No. 13/187,766, patent application Ser. No. 13/186,647, and U.S. Pat. No. 8,979,476, which corresponds to patent application Ser. No. 13/187,964, which disclose these other parts of the pump, pump assembly, arrangement or combination, e.g., including the adjustment plate hold down bolts, adjusting rods and adjustment plate.

Based on all of the aforementioned disclosed herein, a person skilled in the art would be able to adjust the impeller/seal ring setting for the pump assembly, arrangement or combination disclosed, e.g., in the aforementioned patent application Ser. No. 13/187,766, patent application Ser. No. 13/186,647, and U.S. Pat. No. 8,979,476, which corresponds to patent application Ser. No. 13/187,964.

The Basic Method of Adjusting the Impeller/Ring Clearance

The present invention may also take the form of a method for adjusting the seal ring 822 in relation to the impeller 101 (see also FIG. 1) in a pump assembly, arrangement or combination consistent with that shown herein, including that shown in FIG. 3, featuring at least the following steps:

Arranging the seal ring 822 configured with the three left-handed threaded apertures 822*a*, 822*b*, 822*c* in relation to the suction half casing 100A and the suction liner 562 so that the suction liner 562 is between the seal ring 822 and the suction half casing 100A, as shown in FIGS. 1, 2*a*, 2*b* and 3;

Providing the three adjusting screws 356F, each adjusting screw 356F having the first end portion 356F(a), the second end portion 356F(b), the third intermediate raised portion 356F(c) between the first end portion 356F(a) and the second end portion 356F(b), and the fourth portion 356F(d) configured to allow each adjusting screw 356F to be rotated clockwise (CW) or counterclockwise, each first end portion 356F (a) passing through a respective aperture 562*a* of the suction liner 562 and having corresponding left-handed threads that couple to a respective left-handed aperture 822*a* of the seal ring 822, and each second portion 356F(b) passing through a respective aperture 100A(a) of the suction half casing 100A to allow the fourth portion 562F(d) to be accessed to allow each adjusting screw 356F to be rotated clockwise or counterclockwise; and Adjusting the seal ring in relation to the impeller by performing at least one of the following steps:

either rotating each adjusting screw 356F clockwise so as to move axially until the third intermediate raised portion 356F(c) pushes against the inner wall 100A(w) of the suction half casing 100A, causing each adjusting screw 356F to stop moving axially and the seal ring 822 to move away from the suction liner 562 and towards the impeller 101 (see also FIG. 1) as the adjusting screw 356F continues to be rotated clockwise until the adjustment is complete, or rotating each adjusting screw 356F counterclockwise so as to move axially until the third intermediate raised portion 356F(c) of the adjusting screw 356F pushes against the wall 562(*w*) of the suction liner 562, causing the adjusting screw 356F to stop moving axially and the seal ring 822 to move towards the suction liner 562 and away from the impeller 101 (see also FIG. 1) as the adjusting screw 356F continues to be rotated counterclockwise until the adjustment is complete.

SCOPE OF THE INVENTION

Although described in the context of particular embodiments, it will be apparent to those skilled in the art that a number of modifications and various changes to these teachings may occur. Thus, while the invention has been particularly shown and described with respect to one or more preferred embodiments thereof, it will be understood by those skilled in the art that certain modifications or changes, in form and shape, may be made therein without departing from the scope and spirit of the invention as set forth above.

We claim:

1. Apparatus for adjusting a seal member in relation to an impeller in a pump arrangement comprising:

the seal member configured with at least two threaded apertures;

a second pump member;

a third pump member configured between the seal member and the second member; and at least two adjusting screws, each adjusting screw having a first end portion, a second end portion, a third intermediate raised portion between the first end portion and the second end portion, and a fourth portion configured to allow each adjusting screw to be rotated, each first end portion configured to pass through a respective aperture in the third member and configured with corresponding threads that couple to a respective threaded aperture of the seal member, each second portion configured to pass through a respective aperture of the second member to allow the fourth portion to be accessed to allow each adjusting screw to be rotated, and in order to adjust the seal member in relation to the impeller in a first axial direction, each adjusting screw configured to be rotated in a first rotational direction and moved in the first axial direction until the third intermediate raised portion pushes against one of the second member or the third member, causing the adjusting screw to stop moving in the first axial direction, and the seal member to move in a second axial direction that is opposite to the first axial direction in relation to the impeller as the adjusting screw continues to be rotated in the first rotational direction, or in order to adjust the seal member in relation to the impeller in the second axial direction, each adjusting screw configured to be rotated in a second rotational direction that is opposite the first rotational direction and moved in the second axial direction until the third intermediate raised portion of the adjusting screw pushes against the other of the second member or the third member, causing the adjusting screw to stop moving in the second axial direction, and the seal member to move in the first axial direction in relation to the impeller as the adjusting screw continues to be rotated in the second rotational direction.

2. Apparatus according to claim 1, wherein the apparatus is a pump, the seal member is a seal ring of the pump, the second member is a suction half casing of the pump, and the third member is a suction liner of the pump.

3. Apparatus according to claim 2, wherein each adjusting screw is configured to be rotated clockwise and moved axially until the third raised intermediate portion of the adjusting screw pushes against the suction half casing, causing the adjusting screw to stop moving axially, and the seal member to move away from the suction liner and towards the impeller as the adjusting screw continues to be rotated clockwise; or each adjusting screw is configured to be rotated counterclockwise and moved axially until the third raised intermediate portion pushes against the suction liner, causing the adjusting screw to stop moving axially, and the seal member to move towards the suction liner and away from the impeller as the adjusting screw continues to be rotated counterclockwise.

4. Apparatus according to claim 2, wherein each adjusting screw is configured to be rotated clockwise and moved axially until the third raised intermediate portion of the adjusting screw pushes against the suction liner, causing the adjusting screw to stop moving axially, and the seal member to move towards the suction liner and away from the impeller as the adjusting screw continues to be rotated clockwise; or each adjusting screw is configured to be rotated counterclockwise and moved axially until the third raised intermediate portion pushes against the suction half casing, causing the adjusting screw to stop moving axially, and the seal member to move away from the suction liner and towards the impeller as the adjusting screw continues to be rotated counterclockwise.

5. Apparatus according to claim 2, wherein the suction half casing is configured to indicate the direction the adjusting screw should be rotated to move the seal ring in towards the impeller.

6. Apparatus according to claim 1, wherein the seal member is configured with three threaded apertures; and the at least two adjusting screws comprise three adjusting screws, each configured with the first end portion having a left-handed thread.

7. Apparatus according to claim 1, wherein each of the at least two adjusting screws is configured with a respective right-handed thread.

8. Apparatus according to claim 1, wherein the fourth portion of the adjusting screw is configured with either a triangular, square, pentagonal or hex shaped head portion, or a head portion having 12 axial grooves, including a Ferry head, to be engaged by a tool having a corresponding geometric shape.

9. Apparatus according to claim 1, wherein the apparatus comprises a seal ring nut having threads, and wherein each second portion of each adjusting screw is configured with corresponding threads to receive the threads of a seal ring jam nut and lock the adjusting screw in relation to the second member.

10. A pump arrangement comprising:

a seal ring configured with at least three left-handed threaded apertures;

a suction half casing;

a suction liner configured between the seal ring and the suction half casing; and at least three adjusting screws, each adjusting screw having a first end portion, a second end portion, a third intermediate raised portion between the first end portion and the second end portion, and a fourth portion configured to allow each adjusting screw to be rotated clockwise or counterclockwise, each first end portion configured to pass through a respective aperture of the suction liner and configured with corresponding left-handed threads that couple to a respective left-handed aperture of the seal ring, each second portion configured to pass through a respective aperture of the suction half casing to allow the fourth portion to be accessed to allow each adjusting screw to be rotated clockwise or counterclockwise, in order to adjust the seal ring in relation to the impeller in a first axial direction, each adjusting screw configured to be rotated clockwise and moved axially until the third intermediate raised portion pushes against the suction half casing, causing the adjusting screw to stop moving axially and the seal ring to move away from the suction liner and towards the impeller as the adjusting screw continues to be rotated clockwise, or in order to adjust the seal ring in relation to the impeller in a second axial direction that is opposite the first axial direction, each adjusting screw configured to be rotated counterclockwise and moved axially until the third intermediate raised portion of the adjusting screw pushes against the suction liner, causing the adjusting screw to stop moving axially and the seal ring to move towards the suction liner and away from the impeller as the adjusting screw continues to be rotated counterclockwise.

11. A pump arrangement according to claim 10, wherein the fourth portion of the adjusting screw is configured with either a triangular, square, pentagonal or hex shaped head portion, or a head portion having 12 axial grooves, including a Ferry head, to be engaged by a tool having a corresponding geometric shape.

12. A pump arrangement according to claim 10, wherein the apparatus comprises a seal ring jam nut having threads, and wherein each second portion of each adjusting screw is configured with corresponding threads to receive the threads of the seal ring jam nut and lock the adjusting screw in relation to the suction half casing.

13. A pump arrangement according to claim 10, wherein the suction half casing is configured to indicate the direction the adjusting screw should be rotated to move the seal ring in towards the impeller.

14. A method for adjusting a seal ring in relation to an impeller in a pump arrangement comprising:

arranging the seal ring configured with at least three left-handed threaded apertures in relation to a suction half casing and a suction liner so that the suction liner is configured between the seal ring and the suction half casing;

providing at least three adjusting screws, each adjusting screw having a first end portion, a second end portion, a third intermediate raised portion between the first end portion and the second end portion, and a fourth portion configured to allow each adjusting screw to be rotated clockwise or counterclockwise, each first end portion passing through a respective aperture of the suction liner and having corresponding left-handed threads that couple to a respective left-handed aperture of the seal ring, and each second portion passing through a respective aperture of the suction half casing to allow the fourth portion to be accessed to allow each adjusting screw to be rotated clockwise or counterclockwise; and adjusting the seal ring in relation to the impeller by performing at least one of the following steps:

rotating each adjusting screw clockwise so as to move axially until the third intermediate raised portion pushes against the suction half casing, causing each adjusting screw to stop moving axially and the seal ring to move away from the suction liner and towards the impeller as the adjusting screw continues to be rotated clockwise until an adjustment is complete in a first axial direction, or rotating each adjusting screw counterclockwise so as to move axially until the third intermediate raised portion of the adjusting screw pushes against the suction liner, causing the adjusting screw to stop moving axially and the seal ring to move towards the suction liner and away from the impeller as the adjusting screw continues to be rotated counterclockwise until the adjustment is complete in a second axial direction that is opposite the first axial direction.

15. Apparatus according to claim 14, wherein the suction half casing is configured to indicate the direction the adjusting screw should be rotated to move the seal ring in towards the impeller.

* * * * *